US010444706B2

(12) United States Patent
Conus et al.

(10) Patent No.: US 10,444,706 B2
(45) Date of Patent: Oct. 15, 2019

(54) SPIRAL SPRING FOR A SPRUNG BALANCE SPIRAL RESONATOR AND METHOD FOR MANUFACTURING THE SAME

(71) Applicant: ETA SA Manufacture Horlogere Suisse, Grenchen (CH)

(72) Inventors: Thierry Conus, Lengnau (CH); Kaspar Trumpy, Soleure (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 16/210,811

(22) Filed: Dec. 5, 2018

(65) Prior Publication Data

US 2019/0107809 A1 Apr. 11, 2019

Related U.S. Application Data

(63) Continuation of application No. 14/681,535, filed on Apr. 8, 2015, now abandoned, which is a continuation (Continued)

(30) Foreign Application Priority Data

Feb. 6, 2003 (EP) ..... 03075362

(51) Int. Cl.

| | |
|---|---|
| ***G04B 17/34*** | (2006.01) |
| ***G04B 17/06*** | (2006.01) |
| ***G04D 3/00*** | (2006.01) |

(52) U.S. Cl.

CPC ..... *G04B 17/34* (2013.01); *G04B 17/066* (2013.01); *G04B 17/345* (2013.01); *G04D 3/0041* (2013.01); *G04D 3/0069* (2013.01)

(58) Field of Classification Search

CPC .... G04B 17/063; G04B 17/066; G04B 17/26; G04B 17/28; G04B 17/32; G04B 17/34; (Continued)

(56) References Cited

U.S. PATENT DOCUMENTS

| | | | |
|---|---|---|---|
| 209,642 | A | 11/1878 | Berlitz et al. |
| 345,840 | A | 7/1896 | Gribi |

(Continued)

FOREIGN PATENT DOCUMENTS

| | | |
|---|---|---|
| BE | 526 689 | 3/1954 |
| CH | 465 537 | 7/1968 |

(Continued)

OTHER PUBLICATIONS

H. Jendritzki, "Le regalage d"une montre a balancier spiral", 1961, Edition Scriptar S.A., Lausanne (CH) XP002266616, page 45.

(Continued)

*Primary Examiner* — Edwin A. Leon
(74) *Attorney, Agent, or Firm* — Oblon, McClelland, Maier & Neustadt, L.L.P.

(57) ABSTRACT

The spiral includes turns of rectangular section, whose pitch p and/or thickness e can vary from the inside curve towards the outside curve, or whose winding can deviate from the line of a perfect spiral. The inside curve can also be extended by a self-locking washer for fixing the spiral on the balance arbour with no play. The spiral is manufactured by photolithography and galvanic growth, or by micro-machining an amorphous or crystalline material, such as a silicon wafer.

19 Claims, 6 Drawing Sheets

Related U.S. Application Data of application No. 10/544,644, filed as application No. PCT/EP2004/000931 on Feb. 2, 2014, now abandoned.

(58) Field of Classification Search

CPC ..... G04B 17/345; F16F 1/14; G04D 3/0041; G04D 3/0069

USPC ..... 368/175

See application file for complete search history.

(56) References Cited

U.S. PATENT DOCUMENTS

| | | | | |
|---|---|---|---|---|
| 570,394 | A | 10/1896 | Griscom | |
| 2,649,684 | A | 8/1953 | Dolby | |
| 2,842,935 | A | 7/1958 | Bradley | |
| 3,186,157 | A | 6/1965 | Egger et al. | |
| 3,364,673 | A | 1/1968 | Boult | |
| 3,396,450 | A | 8/1968 | Faehndrick et al. | |
| 3,686,081 | A | 8/1972 | Butler et al. | |
| 4,084,764 | A | 4/1978 | Moegeriein et al. | |
| 4,571,661 | A | 2/1986 | Hoshino | |
| 4,595,184 | A | 6/1986 | Boehm et al. | |
| 4,661,212 | A | 4/1987 | Ehrfeld et al. | |
| 4,990,827 | A | 2/1991 | Ehrfeld et al. | |
| 5,576,250 | A | 11/1996 | Diem et al. | |
| 5,747,743 | A | 5/1998 | Kato et al. | |
| 7,018,092 | B2 | 3/2006 | Muller | |
| 7,077,562 | B2 | 7/2006 | Bourgeois et al. | |
| 7,229,208 | B2 | 6/2007 | Verado et al. | |
| 9,239,569 | B2 * | 1/2016 | Cabezas Jurin ..... | G04B 17/066 |
| 9,268,307 | B2 * | 2/2016 | Conus ..... | G04B 17/066 |
| 9,411,314 | B2 * | 8/2016 | Daout ..... | G04B 17/345 |
| 10,018,964 | B2 * | 7/2018 | Helfer ..... | G04B 17/063 |
| 2001/0038603 | A1 | 11/2001 | Morales | |
| 2002/0115016 | A1 | 8/2002 | Warren | |
| 2005/0068852 | A1 | 3/2005 | Hessler et al. | |
| 2006/0055097 | A1 | 3/2006 | Conus et al. | |
| 2009/0135679 | A1 | 5/2009 | Musy et al. | |
| 2010/0061192 | A1 | 3/2010 | Hessler et al. | |

FOREIGN PATENT DOCUMENTS

| | | |
|---|---|---|
| CH | 12 491/66 | 10/1968 |
| DE | 71 12 828 | 4/1973 |
| DE | 2417777 A | 10/1975 |
| EP | 1 256 854 A | 11/2002 |
| EP | 1 422 436 A1 | 5/2004 |
| EP | 1 431 844 A1 | 6/2004 |
| EP | 1 445 670 A1 | 8/2004 |
| FR | 1 271 100 | 9/1961 |
| FR | 1 546 209 | 11/1968 |
| GB | 1 020 456 | 2/1966 |
| GB | 1 080 068 | 8/1967 |
| JP | 1-303333 | 12/1989 |

OTHER PUBLICATIONS

International Search Report for PCT/EP2004/000931, completed Sep. 29, 2004 and dated Oct. 18, 2004.

Harendt, Christine et al., "Wafer bonding and its application to silicon-on-insulator fabrication," Technical Digest, '90, Micromechanics Europe 1990. Nov. 1990, pp. 81-86.

DeFossf7, Leopold, "Theorie generale de horlogerie," edited by Chambre Suisse de l'Horlogerie, La Chaux-de-Fonds, Switzerland, 1952, pp. 338-339.

Webster's New Collegiate Dictionary, 1977, p. 1227.

Charles-Andre Reyrnondin et al., Theorie D'Horlogerie 152, Federation des Ecoles Techniques 1998.

The Illustrated Science and Invention Encyclopedia 2190-2191, H.S. Stuttman Co., Inc., 1977.

Hans C. Ohanian, Physics 135, 136 and 341-343 (W.W. Norton & Company, Inc. 1985).

Illustrated Froffessional Dictionary of Horology I + II 87 and 609 (2002).

http://en.wikipedia.org/wiki/Balance_spring, downloaded Jun. 14, 2010 (5 pages).

"Explanation of How to Regulate a Watch," at http://www.timezone.com/library/archives. . . _ downloaded Jun. 14, 2010, (2 pages).

https://www.iwc.com/jobs/trainee/stage1-en.asp, "The prelude to a living watch." downloaded Dec. 28, 2009, four pages.

International Search Report issued in corresponding application No. PCT/EP2007/051065, completed May 15, 2007 and dated May 29, 2007.

European Search Report issued in corresponding application EP 06 00 2642, completed Dec. 4, 2006.

The Theory of Horology 138 and 139 (The Technical College of the Vallee de Joux 2003).

Notice of Allowance issued in co-pending related U.S. Appl. No. 12/279,021 on Jun. 23, 2011.

* cited by examiner

SPIRAL SPRING FOR A SPRUNG BALANCE SPIRAL RESONATOR AND METHOD FOR MANUFACTURING THE SAME

CROSS REFERENCE TO RELATED APPLICATIONS

This application is a continuation application of U.S. patent application Ser. No. 14/681,535, filed Apr. 8, 2015, which is a continuation of U.S. patent application Ser. No. 10/544,644, filed Aug. 5, 2005, which is a National Phase Application in the United States of International Patent Application No. PCT/EP2004/000931, filed Feb. 2, 2004, which claims priority on European Patent Application No. 03075362.8, filed Feb. 6, 2003. The entire disclosures of the above patent applications are hereby incorporated by reference.

FIELD OF THE INVENTION

The present invention concerns a flat resonator spiral for a sprung balance obtained by a manufacturing method for improving isochronism by acting, on the one hand, on construction parameters of the spiral as such, and on the other hand, on a mode of securing it to the balance arbour for reducing the geometrical deviation inherent to conventional securing modes between the point of origin of the spiral of Archimedes and the rotational axis of the balance. In the following description, isochronism means the working deviations as a function of variations in the oscillation amplitude of the balance, as well as working deviations between the horizontal position and the vertical positions of the watch.

BACKGROUND OF THE INVENTION

In a known manner a spiral, having turns of uniform section and pitch, via a particular conformation of the inside curve and the outside curve in the plane of the spiral or most often in different planes, enables one to obtain a concentric development of the spiral and a movement of the centre of the spiral weight and a variation in the spiral's inertia during development minimising working disruptions as a function of the amplitude and positions of the spiral with respect to the gravity vector. In addition to the fact that making such a spiral requires great skill, the space required in height constitutes a certain drawback for its use in wristwatches that have to have, for evident aesthetical reasons, the smallest possible thickness.

For this reason, use of a flat spiral is preferred, such as that shown in FIG. 1. Such a spiral is manufactured in a known manner by winding from a wire or metal band of constant section over its entire length, and has a constant pitch at rest between the turns. As can be seen in FIG. 1, the inside curve is fixed, for example by laser welding, onto a collet 20, driven onto the arbour 9 of a balance 8.

With respect to this state of the art, as regards the pitch between the turns, CH Patent No. 465 537, filed in 1966, should be mentioned, wherein there is disclosed a method for manufacturing spirals of any configuration, particularly with a variable pitch, from a metal strip or wire of constant section, wound in the groove of a die, then annealed and hardened. To the knowledge of the Applicant, no products of this type have been put on the market, which leads one to assume that the manufacturing method was not, technically or economically, satisfactory.

As regards the variation in thickness of a wound metal strip, GB Patent No. 1020 456 can be mentioned, which discloses the manufacture of a mainspring by buttwelding of strips having sections that increase from the centre to the periphery. Such a spring is designed, with equal space requirement, to increase the power reserve, but it is clear that by applying this manufacturing method to a spiral, the presence of welds would prevent a concentric development and would not allow reproducible isochronism to be obtained from one spiral to another.

This same principle had, moreover, already been proposed in U.S. Pat. No. 209,642 dating 1878, for improving the isochronism of a spiral made with an inside turn of smaller section. As will be seen in the detailed description, experiments contradict this assertion.

SUMMARY OF THE INVENTION

The invention thus concerns a flat spiral and micro-machining or galvanic growth manufacturing methods, for selecting the most favourable construction parameters in a convenient way for the purpose of improving isochronism by the shape of the spiral as well as by the securing means.

The invention therefore concerns a flat spiral, formed of a strip made up of a succession of turns having a pitch "p" between them, for a regulating balance mechanism, said spiral being obtained by a manufacturing method which allows almost perfect isochronism. The turns of rectangular section are formed in a single continuous material from the inside curve to the outside curve, but, on certain portions comprised between the point of attachment at the centre and the point of attachment at the exterior, have a section "s" that is non uniform and/or one or more portions shaped outside the tracing of a perfect spiral. The expression "non uniform section" means that, for a strip having a constant height "h", the thickness "e" of a selected portion can be either greater or less than the thickness of the rest of the strip forming the spiral.

As will be explained hereinafter in the detailed description, the manufacturing method relies on micro-techniques, such as photolithography and electroplating a metal or metal alloy, or micro-machining a plate of thickness "h" made of an amorphous or crystalline material such as silicon in mono-crystalline or polycrystalline form.

According to a first embodiment, the section "s" of the turns increases progressively from the outside curve to the inside curve.

According to a second embodiment, which can be combined with the first embodiment, the pitch "p" between the turns decreases regularly from the outside curve to the inside curve.

According to yet another embodiment, it is possible to select a determined turn portion and vary the width of the strip locally in order to act on other parameters favourable to isochronism. This increase may be achieved for example on the inside curve, on the outside curve or on both curves at once, or in many other places on other portions of the spiral.

It is also possible to obtain a spiral having a turn portion that deviates from the curve of a perfect spiral, by having, for example, a Grossmann type inside curve.

The invention also offers the advantage of being able to manufacture at the same time both the actual spiral and the means for securing it onto the balance arbour, this securing means being formed by a self-locking washer having at the centre, for example a star-shaped contour and including recesses in its periphery to give it sufficient elasticity for assembly and preventing a deviation between the point of origin of the spiral of Archimedes and the rotational axis of the balance.

For a metal or metal alloy spiral, the manufacturing method basically consists in applying the LIGA technique to form a mould corresponding to the desired profile of the spiral. Given the properties of the photoresists currently available on the market, it is possible to adjust the thickness of the photoresist layer to obtain the entire range of spirals with strip heights of up to several tens of a millimeter.

For a spiral made of amorphous or crystalline material, the method basically consists in etching a plate of said material through masks.

BRIEF DESCRIPTION OF THE ILLUSTRATIVE EMBODIMENTS

Other features and advantages of the present invention will appear in the following description of different embodiment examples given by way of non-limiting illustration with reference to the annexed drawings, in which.

DETAILED DESCRIPTION OF THE INVENTION

Figure 1:
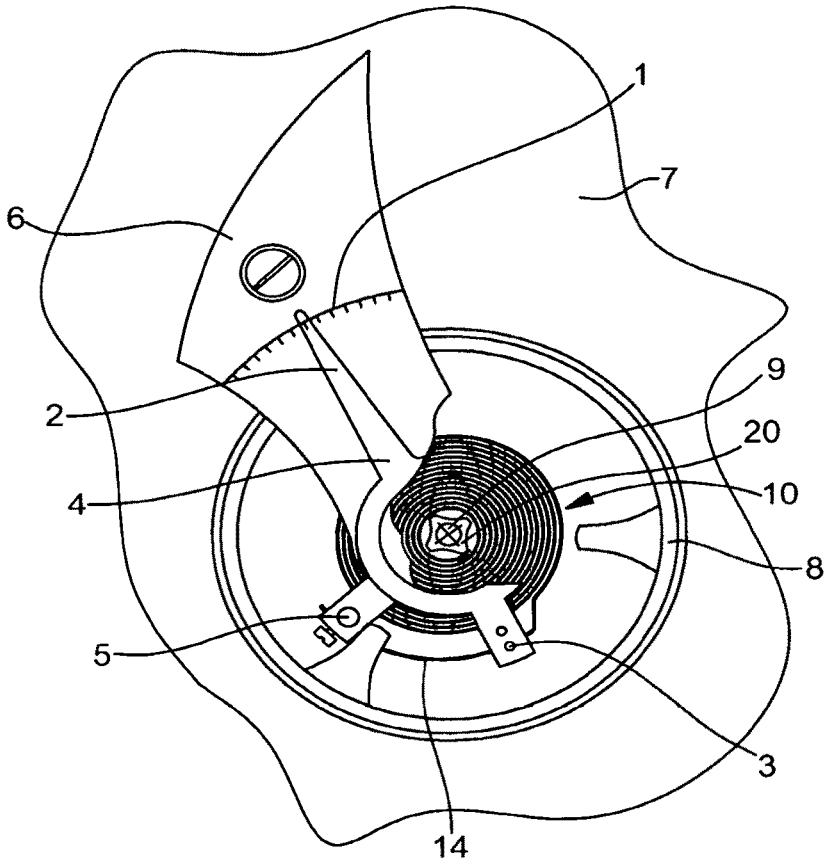
Fig.1 Prior Art
FIG. 1 shows a sprung balance of the prior art.
Figure 2:
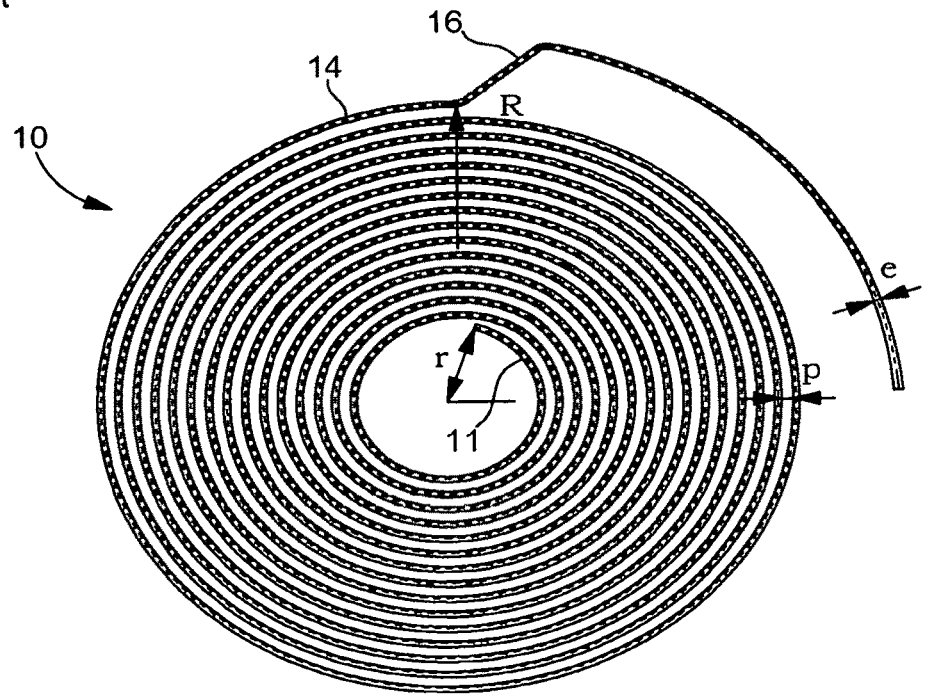
Fig.2 Prior Art
FIG. 2 is an enlarged diagram of the spiral of FIG. 1.

FIG. 1, which is partially torn away, shows a sprung balance of the prior art referred to in the preamble. Its features serve as a reference to show the significant progress brought by the invention as regards isochronism. Spiral 10 has the end of its curve at the centre 11 secured in a conventional manner onto a collet 20 driven onto the arbour 9 of the balance 8 pivoted between the plate 7 and the balance-cock 6. The regulating device further includes in a known manner a balance spring stud holder 5 for securing the outside curve 14 of spiral 10 and an index 4 provided with pins 3 and an index tail 2 facing a scale 1. In FIG. 2, which is an enlarged diagram of spiral 10 alone, it can be seen that said spiral is formed of 14 turns having a uniform rectangular section, for example 0.05×0.30 mm from the centre curve 11 to the outside curve 14, and that the turns have a constant pitch between them. The point of attachment of the centre curve 11 is located at a distance r from the centre of pivoting of the spiral, and that of outside curve 14, at a distance R, before the bend 16. In this example r and R have the respective values 0.57 mm and 2.46 mm. These values of r and R, and the number of turns, will be the same in the following description, unless otherwise indicated.

Figure 3A:
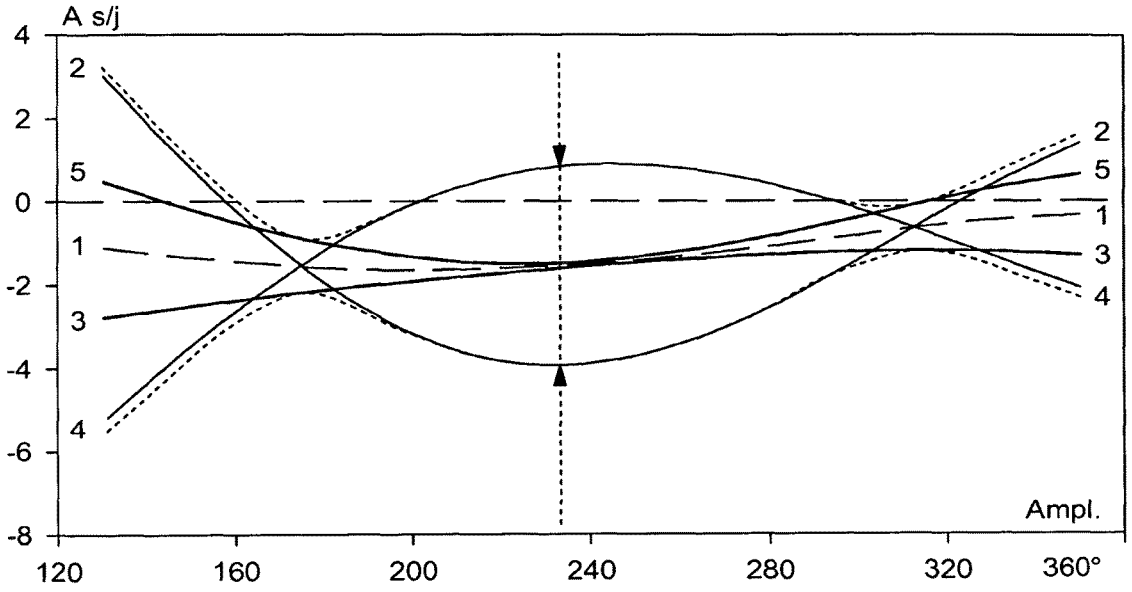
Fig.3a Prior Art
FIG. 3A is a diagram of the isochronism obtained with the spiral shown in FIG. 2.

With reference now to FIG. 3A, there is shown the isochronism diagram of a spiral having the aforementioned features. The oscillation amplitude of the balance expressed in degrees with respect to its position of balance is shown on the X axis The working deviation expressed in seconds per day is shown on the Y axis. This diagram includes five curves corresponding to the usual measurement positions with the sprung balance, horizontal (curve 1), then vertical (curves 2 to 5, by rotation through 90° from one curve to the other). The dotted line corresponds to the envelope of all the most unfavourable positions. Appreciation of the working deviation is carried out in a conventional manner by taking into consideration the maximum deviation of the envelope for an amplitude comprised between 200° and 300°. In the diagram of FIG. 3A, it can be seen that this maximum deviation, with this reference spiral of the prior art, is 4.7 seconds per day for an amplitude of 236°.

Figure 3B:
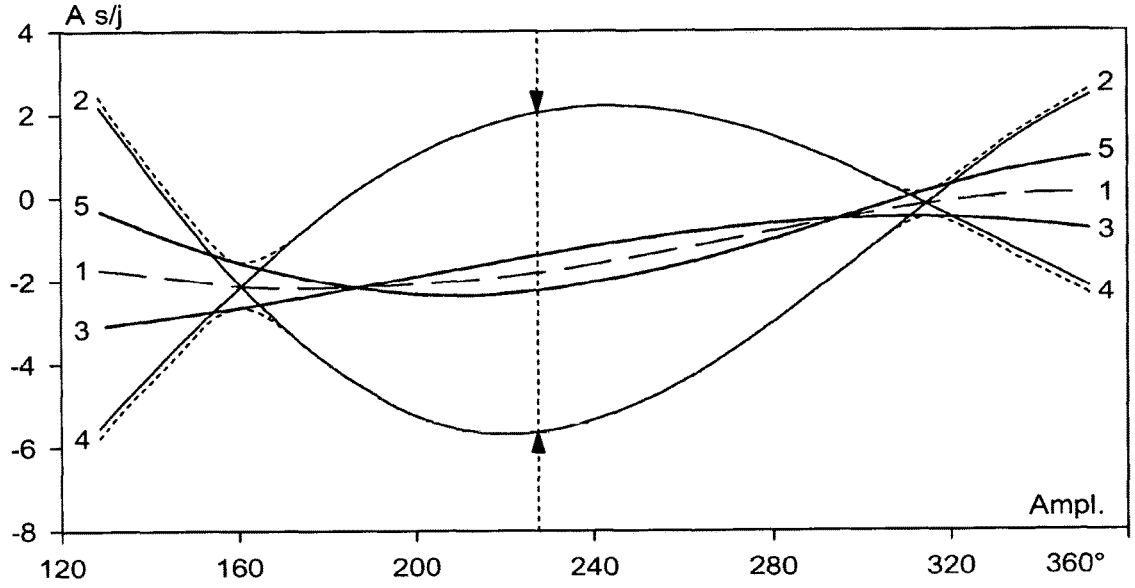
Fig.3b Prior Art
FIG. 3B is a diagram of the isochronism obtained with another spiral of the prior art.

FIG. 3B shows the diagram obtained with a spiral (not shown) having the features mentioned in U.S. Pat. No. 209,642 cited in the preamble, namely with a strip thickness varying between 0.046 mm for outside curve 14 and 0.036 mm for inside curve 11. Contrary to what might be expected from the teaching of said patent, it will be observed that the maximum deviation has increased to 7.7 seconds per day for an amplitude of 230°.

Figure 4:
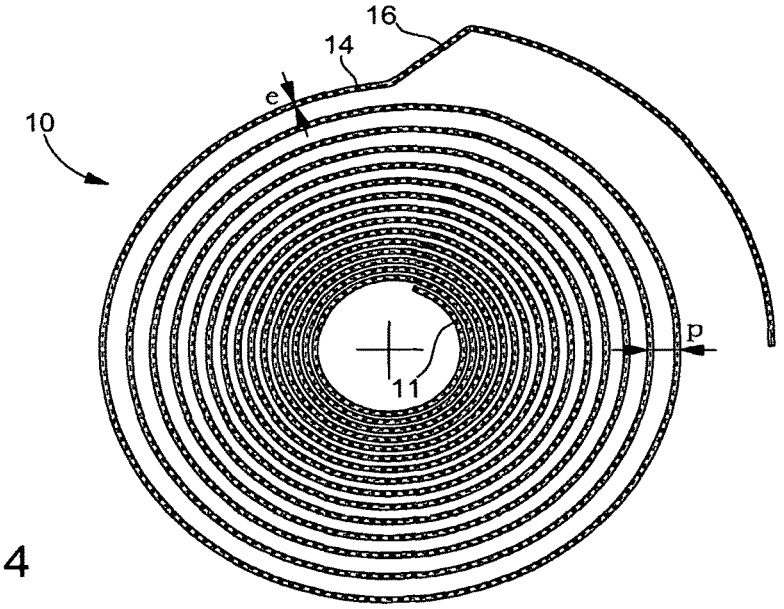
FIG. 4 shows a first embodiment of a spiral according to the invention.
Figure 5:
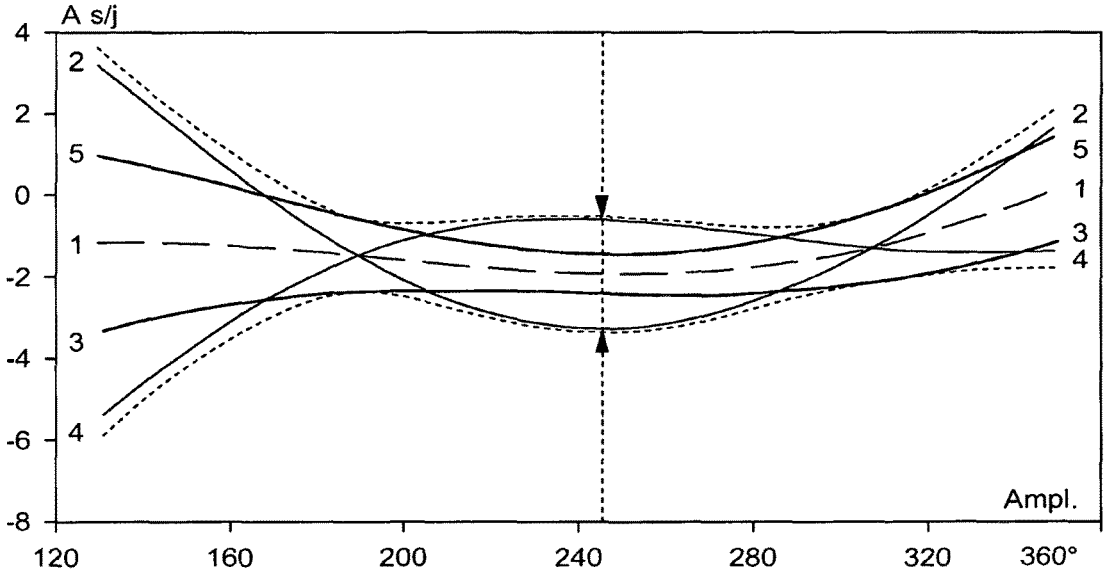
FIG. 5 is a diagram of the isochronism obtained with the spiral of FIG. 4.

With reference now to FIGS. 4 and 5, there will be described a first embodiment of a spiral the manufacture of which by micro-machining (photolithography and galvanic growth), or etching an amorphous or crystalline material allows geometry favourable to isochronism to be obtained. As can be seen, the pitch between one turn and the next decreases gradually towards the centre of the spiral. Conversely, the section increases from the outside curve 14 to the inside curve 11. Given that the manufacturing methods give the strip a constant height, the variation in section in fact corresponds to a change in the thickness which goes from 0.036 mm for the outside curve 14 to 0.046 mm for the inside curve 11.

In the diagram shown in FIG. 5, it can be seen that the maximum deviation is decreased to 2.8 seconds per day for an amplitude of 242°. A favourable result could be obtained on this maximum deviation by acting solely, either on pitch or on thickness e of the strip.

Figure 6:
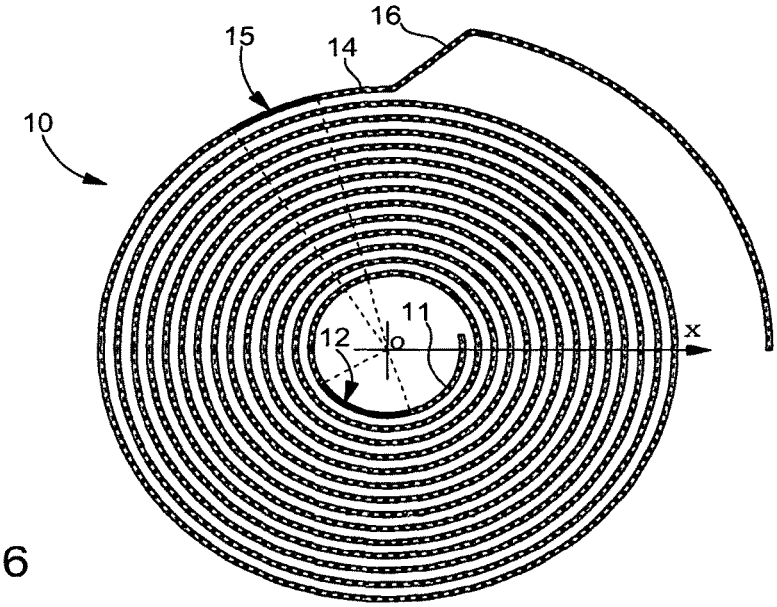
FIG. 6 shows a second embodiment of a spiral according to the invention.
Figure 7:
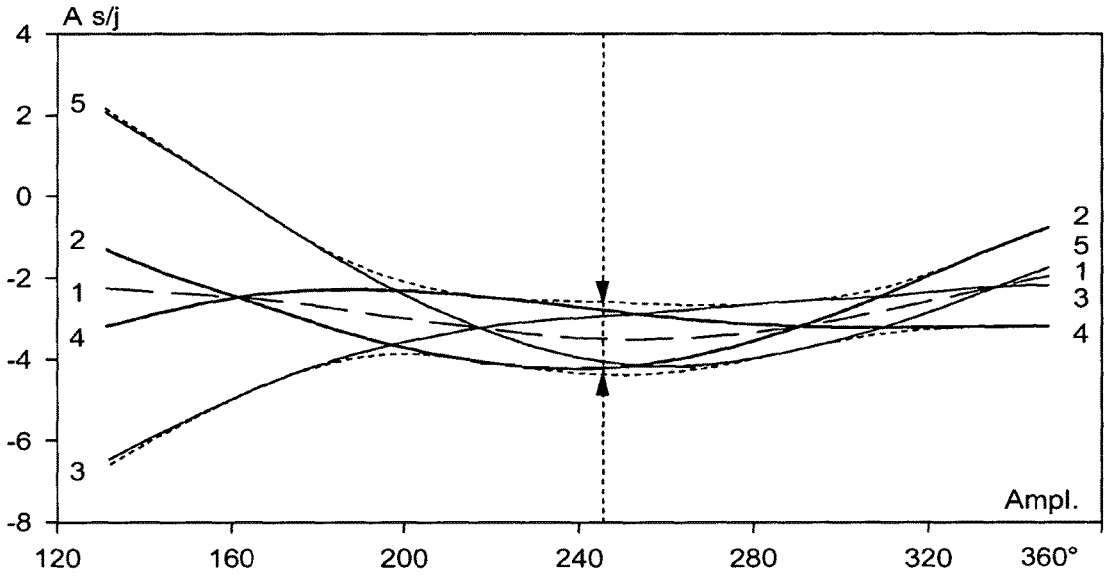
FIG. 7 is a diagram of the isochronism obtained with the spiral of FIG. 6.

FIGS. 6 and 7 correspond to a second "Michel" type embodiment for the outside curve 14 and for inside curve 11. The turns have a constant pitch between them and constant section corresponding to a constant thickness of 0.042 mm, with the exception of two turn portions for which the thickness is brought to 0.056 mm:

- a portion 12 of inside curve 11 over an angular sector of approximately 80° the median part of which is at substantially −110° from a reference axis Ox, and
- a portion 15 of outside curve 14 over an angular sector of approximately 20° the median part of which is at substantially +115° from reference axis Ox.

In the diagram shown in FIG. 7 it can be seen that the maximum deviation is no more than 1.8 seconds per day. The value of the overthickness and the positions on the turns are given here solely by way of illustration, and it is clear that those skilled in the art can choose to have a larger number of zones of overthickness at different locations.

Figure 8:
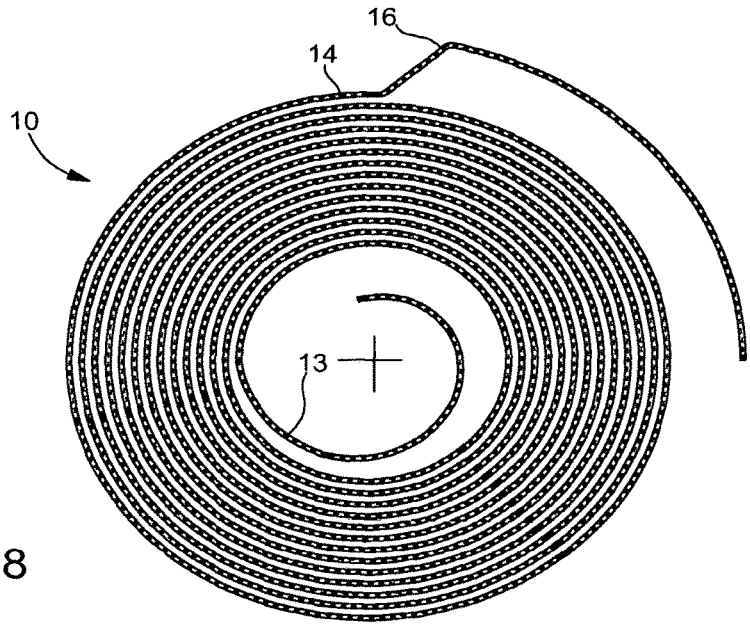
FIG. 8 shows a third embodiment of a spiral according to the invention.
Figure 9:
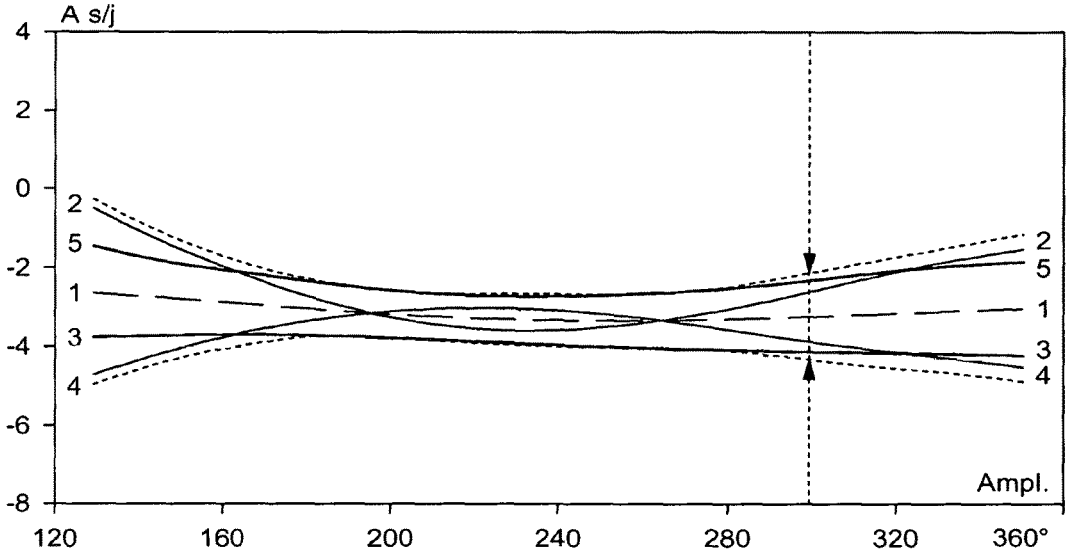
FIG. 9 is a diagram of the isochronism obtained with the spiral of FIG. 8.

FIGS. 8 and 9 show a third embodiment wherein inside curve 11 is of the Grossmann type 13, i.e. having the geometry described in the work "Théorie générale de l'horlogerie" by L. Defossez. This geometry is very difficult to obtain by deforming a metal strip. The manufacturing method according to the invention however allows such a configuration to be obtained very easily without any intervention by a highly qualified person. The diagram shown in FIG. 9 shows that the maximum deviation at 300° is only 2.1 seconds per day.

Of course, given the freedom of configuration provided by the manufacturing methods according to the invention, it is possible to combine the embodiments previously described to obtain a spiral according to the invention having improved isochronism.

Figure 10:
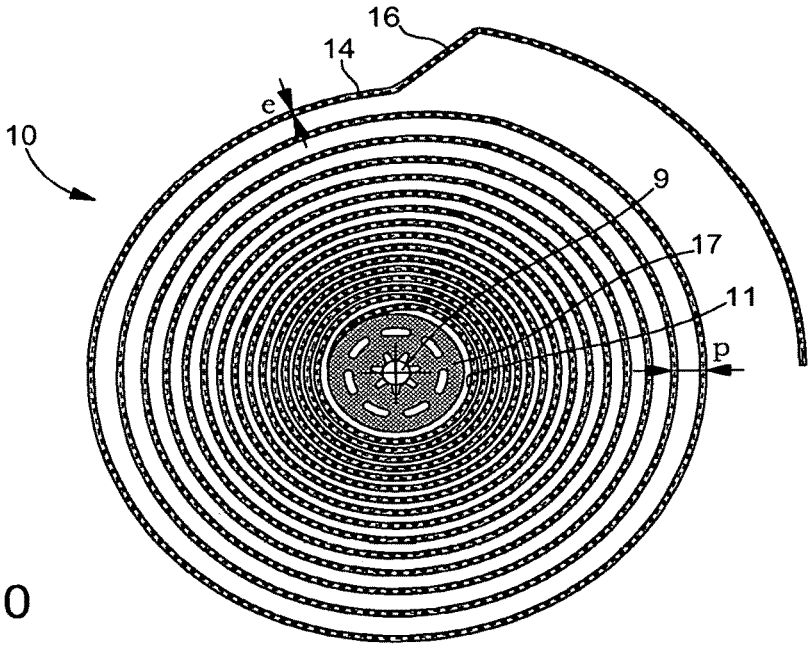
FIG. 10 shows a mode of securing a spiral according to the invention.
Figure 10A:
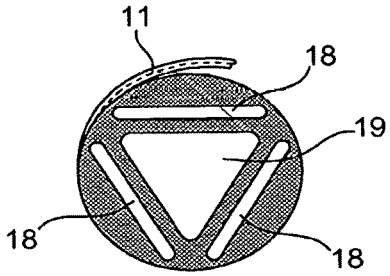
FIGS. 10A to 10E show other forms for securing the spiral to the centre.
Figure 10B:
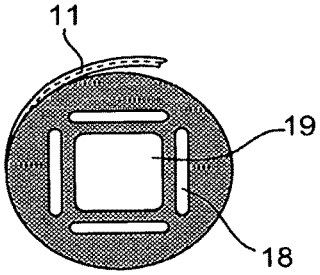
Figure 10C:
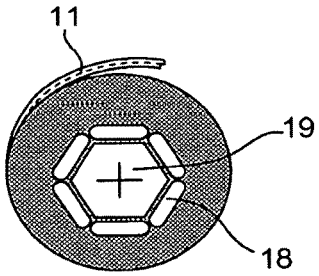
Figure 10D:
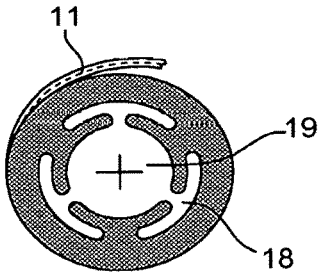
Figure 10E:
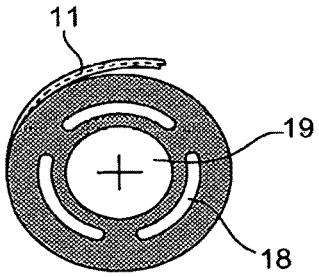

FIG. 10 shows a spiral corresponding to the first embodiment (FIG. 4) wherein the collet 20 is replaced by a self-locking washer 17 formed at the same time as spiral 10. This washer 17 has at its centre a contour 19 such that it allows the arbour 9 of balance 8 to be locked without any play while having a certain elasticity provided by holes 18 distributed about the locking contour 19 shown in a star in FIG. 10. FIGS. 10A to 10E show other possible configurations of self-locking washer 17 with a triangular, square, hexagonal, circular or nose-shaped locking contour 19. When the spiral-self-locking washer assembly is made by photolithography and galvanic growth, one can advantageously make said self-locking washer 17, by means of an additional step, with a thickness greater than the height of the strip in order for spiral 10 to be held better on balance arbour 9.

A spiral according to the invention made of an amorphous or crystalline material such as silicon can be manufactured by adapting the micro-machining methods already used for example for manufacturing integrated circuits or acceleration meters from a silicon wafer. Reference can be made in particular to the methods disclosed in U.S. Pat. Nos. 4,571,661 and 5,576,250 concerning acceleration meters. The method basically consists of the following steps:

applying a silicon wafer to a substrate creating an insulating $SiO_2$ interface;

thinning the plate to the desired strip height "h" in accordance with the method described by C. Harendt et al. ("Wafer bonding and its application to silicon-on-insulator fabrication" Technical Digest MNE'90, 2$^{nd}$ Workshop, Berlin, November 90, p. 81-86);

forming a mask by photolithography corresponding to the desired spiral contour;

etching the silicon wafer to the substrate, in accordance with known methods, such as wet method chemical etching, dry plasma etching or a combination of the two; and separating the spiral from the substrate.

Given the very small dimensions of a spiral, it is obviously possible and advantageous to manufacture them in batches from a single silicon wafer.

In order to manufacture a metal or metal alloy spiral according to the invention, the LIGA method, known since the middle of the 70s is used. In a first step, the method basically consists in spreading a positive or negative photoresist on a substrate previously coated with a sacrificial layer, over a thickness corresponding to the desired strip height "h" and forming a hollow structure corresponding to the desired spiral contour by means of a mask by photolithography and chemical etching. In a second step, said hollow structure is filled with a metal or a metal alloy either by electroplating as indicated for example in U.S. Pat. No. 4,661,212, or by nanoparticle compression and sintering, as indicated for example in US Patent Application No. 2001/0038803.

In a last step the spiral is released from the substrate by removing the sacrificial layer.

The invention claimed is:

1. A watch movement comprising:

(a) a regulating balance mechanism, including (i) a balance;

(ii) a spring;

(iii) an arbour;

(iv) a plate; and (v) a balance-cock, wherein the balance and the spring are mounted on the arbour, and wherein the arbour is pivotable between the plate and the balance-cock, wherein the spring comprises a single strip made up of a succession of turns, wherein an end of an inside curve of the strip is secured to the arbour and an end of an outside curve of the strip is secured to the balance-cock or to a part secured thereto, wherein a portion of the strip between the outside curve and the inside curve has a rectangular constant section with a constant height and a constant thickness, wherein only a portion of the outside curve, the portion of the outside curve being located entirely on an outermost turn of the succession of turns, and a portion of the inside curve, the portion of the inside curve being located entirely on an innermost turn of the succession of turns, have a larger section than that of the single strip forming all of the other turns.

2. The watch movement according to claim 1, wherein the spring is made of silicon in monocrystalline or polycrystalline form.

3. The watch movement according to claim 1, wherein the spring is made of a metal or a metal alloy.

4. The watch movement according to claim 1, wherein the portion of the outside curve with a larger section is obtained by only varying the thickness of the strip.

5. The watch movement according to claim 4, wherein the portion of the outside curve with a larger section has an angular sector of 20°.

6. The watch movement according to claim 5, wherein the portion of the outside curve with a larger section is centered on a median part which is at +115° from reference axis Ox passing through a center of the spring and the end of the outside curve.

7. The watch movement according to claim 6, wherein the portion of the inside curve with a larger section is centered on a median part which is at −110° from reference axis Ox passing through a center of the spring and the end of the inside curve.

8. The watch movement according to claim 1, wherein the constant thickness of the portion of the strip between the outside curve and the inside curve is 0.042 mm.

9. The watch movement according to claim 1, wherein the watch movement includes a constant pitch between the turns.

10. The watch movement according to claim 1, wherein the spring is mounted on the arbour via a collet.

11. The watch movement according to claim 1, wherein the spring is mounted on the arbour via a self-locking washer.

12. The watch movement according to claim 11, wherein the self-locking washer includes a contour at a center of the self-locking washer and a plurality of openings positioned around the contour.

13. The watch movement according to claim 12, wherein the contour has a triangular, square, hexagonal, or circular shape.

14. The watch movement according to claim 11, wherein the self-locking washer is formed integrally with the spring.

15. The watch movement according to claim 11, wherein the self-locking washer is formed integrally with the spring via photolithography and galvanic growth.

16. A watch movement comprising:

(a) a regulating balance mechanism, including (i) a balance;

(ii) a spring;

(iii) an arbour;

(iv) a plate; and (v) a balance-cock, wherein the balance and the spring are mounted on the arbour, and wherein the arbour is pivotable between the plate and the balance-cock, wherein the spring comprises a single strip made up of a succession of turns, wherein an end of an inside curve of the strip is secured to the arbour and an end of an outside curve of the strip is secured to the balance-cock or to a part secured thereto, wherein a portion of the strip between the outside curve and the inside curve has a rectangular constant section with a constant height and a constant thickness, the spring is mounted on the arbour via a self-locking washer formed integrally with the spring.

17. The watch movement according to claim 16, wherein the self-locking washer includes a contour at a center of the self-locking washer and a plurality of openings positioned around the contour.

18. The watch movement according to claim 17, wherein the contour has a triangular, square, hexagonal, or circular shape.

19. The watch movement according to claim 16, wherein the self-locking washer is formed integrally with the spring via photolithography and galvanic growth.

* * * * *